US007322426B2

(12) United States Patent
Aguirre et al.

(10) Patent No.: US 7,322,426 B2
(45) Date of Patent: Jan. 29, 2008

(54) METHOD FOR DRIVING A FASTENER WITH A FASTENER DRIVING DEVICE HAVING AN AUTOMATIC DUAL-MODE TRIGGER ASSEMBLY

(75) Inventors: Juan Ignacio Aguirre, East Greenwich, RI (US); Zheng Fang, Cranston, RI (US); Donald R Perron, North Smithfield, RI (US)

(73) Assignee: Stanley Fastening Systems, L.P., East Greenwich, RI (US)

( * ) Notice: Subject to any disclaimer, the term of this patent is extended or adjusted under 35 U.S.C. 154(b) by 0 days.

(21) Appl. No.: 11/491,992

(22) Filed: Jul. 25, 2006

(65) Prior Publication Data

US 2006/0255086 A1 Nov. 16, 2006

Related U.S. Application Data

(63) Continuation of application No. 11/007,581, filed on Dec. 9, 2004, now Pat. No. 7,143,918, which is a continuation-in-part of application No. 10/629,569, filed on Jul. 30, 2003, now abandoned.

(51) Int. Cl.
*B25C 1/04* (2006.01)

(52) U.S. Cl. ..... 173/1; 227/8; 227/130

(58) Field of Classification Search ..... 227/8, 227/120, 130, 129, 156; 173/1
See application file for complete search history.

(56) References Cited

U.S. PATENT DOCUMENTS 3,784,077 A 1/1974 Burke et al.
5,437,339 A 8/1995 Tanaka
5,551,620 A 9/1996 Vallee
5,551,621 A 9/1996 Vallee
5,597,106 A 1/1997 Hamano et al.
6,059,161 A 5/2000 Chang et al.
6,116,488 A 9/2000 Lee
6,213,372 B1 4/2001 Chen
6,357,647 B1 3/2002 Ou
6,533,156 B1 3/2003 Chang
6,543,664 B2 4/2003 Wolfberg
6,659,324 B1 12/2003 Liu
6,662,989 B1 12/2003 Chang et al.
6,675,999 B2 1/2004 Mukoyama et al.
6,860,416 B1 3/2005 Chen
6,929,165 B1 8/2005 Chen et al.
6,953,137 B2 10/2005 Nakano et al.
7,073,697 B2 * 7/2006 Lin ..... 227/8
7,097,084 B2 * 8/2006 Ho ..... 227/8
7,152,773 B2 * 12/2006 Ke ..... 227/8
7,191,927 B2 * 3/2007 Segura ..... 227/8

* cited by examiner

*Primary Examiner*—Scott A. Smith
(74) *Attorney, Agent, or Firm*—Pillsbury Winthrop Shaw Pittman LLP

(57) ABSTRACT

A method for operating a fastener driving device is disclosed. The method includes moving an input actuator of an actuating assembly into an operative position in response to movement of a contact trip assembly and a trigger member into the operative positions thereof. The contract trip assembly includes an output actuator. The method also includes moving an actuating member with respect to the trigger member between a first position and a second position, and moving a mode selecting member together with the actuating member relative to the trigger member between the first and second positions of the actuating member, and relatively moving the mode selecting member with respect to the actuating member.

8 Claims, 14 Drawing Sheets

METHOD FOR DRIVING A FASTENER WITH A FASTENER DRIVING DEVICE HAVING AN AUTOMATIC DUAL-MODE TRIGGER ASSEMBLY

CROSS-REFERENCE TO RELATED APPLICATIONS

This application is a continuation of U.S. patent application Ser. No. 11/007,581, entitled "FASTENER DRIVING DEVICE WITH AUTOMATIC DUAL-MODE TRIGGER ASSEMBLY," filed Dec. 9, 2004, now U.S. Pat. No. 7,143,918, which is a continuation-in-part of U.S. patent application Ser. No. 10/629,569, entitled "FASTENER DRIVING DEVICE WITH AUTOMATIC DUAL-MODE TRIGGER ASSEMBLY," filed Jul. 30, 2003 and abandoned, the contents of which are both incorporated herein by reference in their entireties.

FIELD OF THE INVENTION

The present invention relates to fastener driving devices.

BACKGROUND

Fastener driving devices typically have trigger assemblies that operate in either a "sequential" mode ("place and actuate" mode) or a "contact" mode. In sequential actuation trigger assemblies, the nose of the device must be forced against the workpiece before the trigger is enabled. Therefore, the operator cannot simply pull the trigger to fire the device. Rather, the device must be forced downwardly against the workpiece so that a contact trip assembly associated with the nose moves upwardly to engage an actuator that will render the trigger operative, so that the subsequent pulling of the trigger will fire the device. If the tool recoils, no actuation of the device will occur until the trigger is released and the proper sequence of movement is followed.

In contact actuation trigger assemblies, the trigger is pulled before the nose of the device makes contact with the workpiece. This places the actuator in a position such that the device may be actuated every time the nose of the device is forced against the workpiece. With this sequence of activation, the operator can hold the trigger and subsequently force the nose against the workpiece to fire the device.

Each of the sequential and contact actuation trigger assemblies have advantages depending on the specific application. For example, sequential actuation trigger assemblies eliminate the possibility of accidental double actuation of the device. This is particularly advantageous when using the device for placing joist hangers, for example.

SUMMARY OF THE INVENTION

One aspect of the present invention is to provide a method for operating a fastener driving device. The method includes moving an input actuator of an actuating assembly into an operative position in response to movement of a contact trip assembly and a trigger member into the operative positions thereof. The contact trip assembly has an output actuator. The method also includes moving an actuating member with respect to the trigger member between (1) a first position wherein a portion of the actuating member is moved into a position in which the portion is retained in the path of movement of the output actuator following rebound or manual movement of the contact trip assembly out of its operative position while the trigger member is retained in its operative position following an actuating movement of the input actuator, and (2) a second position wherein the portion of the actuating member is moved into a bypass position in which the portion is out of the path of movement of the output actuator following the rebound or manual movement of the contact trip assembly out of its operative position while the trigger member is retained in its operative position following an actuating movement of the input actuator. The method further includes moving a mode selecting member together with the actuating member relative to the trigger member between the first and second positions of the actuating member, and relatively moving the mode selecting member with respect to the actuating member so that the mode selecting member (a) retains the actuating member in the first position thereof in response to an initial movement of the trigger member to the operative position thereof, and (b) retains the actuating member in the second position thereof in response to an initial movement of the contact trip assembly into the operative position thereof and a subsequent movement of the trigger member into the operative position thereof.

These and other aspects, features and advantages of this invention will become apparent from the following detailed description when taken in conjunction with the accompanying drawings, which are a part of this disclosure and which illustrate, by way of example, the principles of this invention.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

Figure 1:
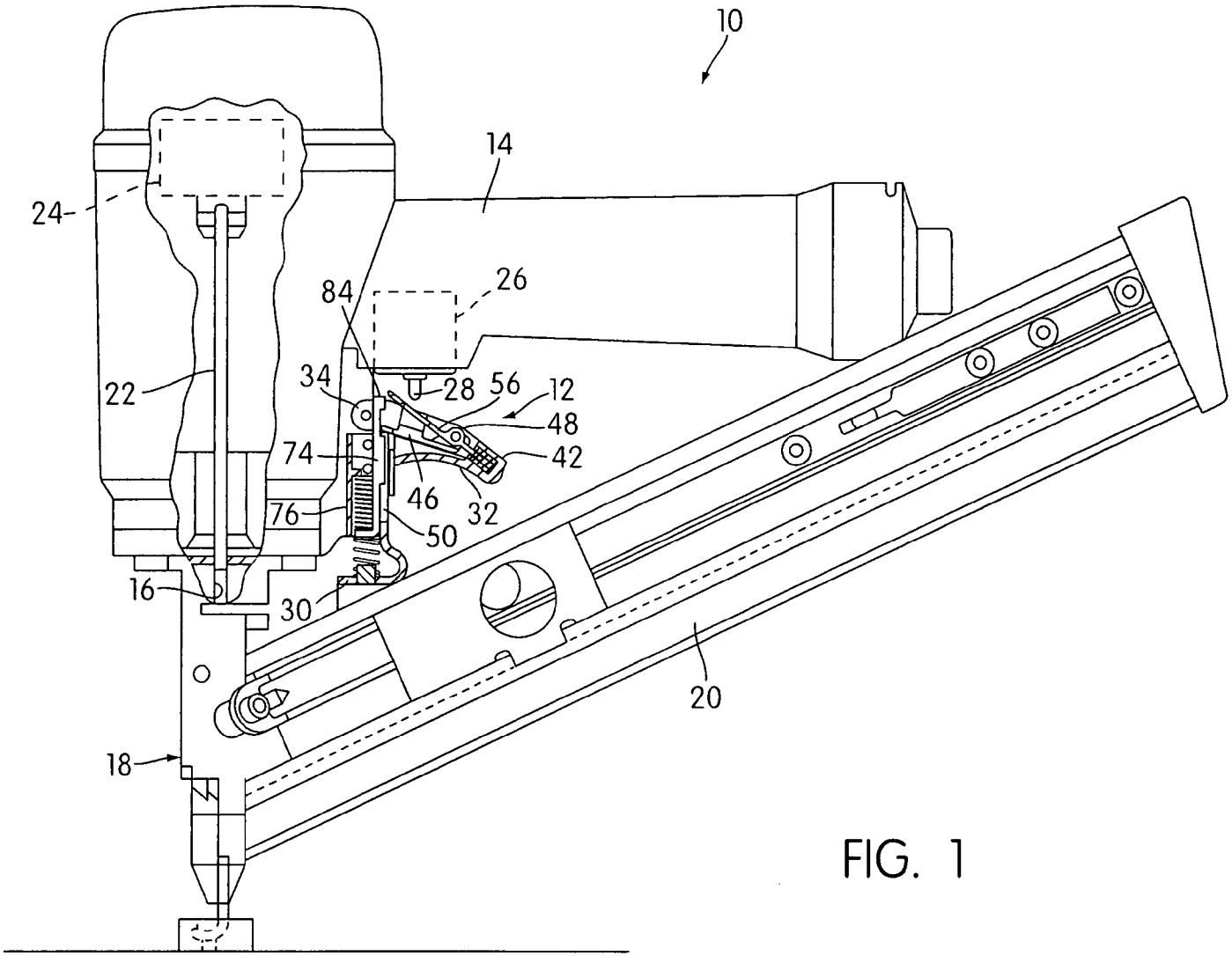
FIG. 1 is a side elevational view, with parts broken away for purposes of clearer illustration, of a fastener driving device having a trigger assembly constructed in accordance with an embodiment of the invention.

FIG. 1 illustrates a fastener driving device 10 having a trigger assembly 12 constructed in accordance with one illustrated embodiment of the present invention. In the illustrated embodiment, the device 10 is of the fluid pressure (e.g., air) operated type, and includes a portable frame 14 constructed and arranged to be manually handled. The frame 14 defines a fastener drive track 16. In the particular embodiment shown, the fastener drive track 16 is provided by a nose assembly 18, which is structured to receive fasteners to be positioned in the fastener drive track 16. Specifically, a magazine assembly 20 is fixed to the nose assembly 18 to feed successive fasteners from a supply of fasteners along a feed track into the fastener drive track 16. The magazine assembly may be in the form of a stick, as illustrated, or in the form of a coil. Also, the device 10 may be structured for use with any suitable fastener, e.g., framing nails, finishing nails, etc.

A fastener driving element 22 is slidably mounted in the fastener drive track 16. The fastener driving device 10 includes a power system 24 constructed and arranged to move the fastener driving element 22 through successive operating cycles each of which includes a drive stroke operable to drive a leading fastener fed along the feed track into the drive track 16 outwardly into a workpiece and a return stroke. In the illustrated embodiment, the power system 24 has a piston/cylinder arrangement with the fastener driving element 22 suitably connected with the piston. However, the power system 24 may assume any desired configuration.

The device 10 includes an actuating assembly 26 that is constructed and arranged to actuate the power system 24 to move through an operating cycle. That is, movement of the piston through successive operating cycles is under the control of the actuating assembly 26. The actuating assembly 26 may assume any desired configuration. In the illustrated embodiment, the actuating assembly 26 includes an input actuator 28 movable from its normal inoperative position into an operative position to actuate the power system 24. Typically, as known in the art, the actuating assembly 26 includes a valve member that is movable between inoperative and operative positions to release and apply pressure to the power system 24. Movement of the valve member is under the control of the input actuator 28 which is biased by a spring into the normally inoperative position. The input actuator 28 is mounted for direct linear movement in a direction toward and away from the trigger assembly 12.

The device 10 also includes a contact trip assembly 30 that is mounted for movement from an inoperative position into an operative position in response to the engagement of the device 10 with a workpiece. In the illustrated embodiment, the contact trip assembly 30 is operatively associated with the nose assembly 18. By forcing the nose assembly 18 into contact with a workpiece, the contact trip assembly 30 moves from its inoperative position to its operative position.

Further details of construction of the above aspects of device 10 are not necessary to an understanding of the present invention. Further details of embodiments of structure and operation of power systems and actuating assemblies are known in the art, for example, see U.S. Pat. Nos. 3,784,077 and 5,083,694, the entireties of which are herein incorporated by reference. It should be appreciated that the above disclosure and the two aforementioned patents provide mere examples of the types of components that can be employed in carrying out the principles of the present invention, and the claims directed to the present invention contemplate all functionally similar arrangements. The present invention is more particularly concerned with the contact trip assembly 30 and the trigger assembly 12 that initiates the drive stroke of the fastener driving element 22.

Figure 2:
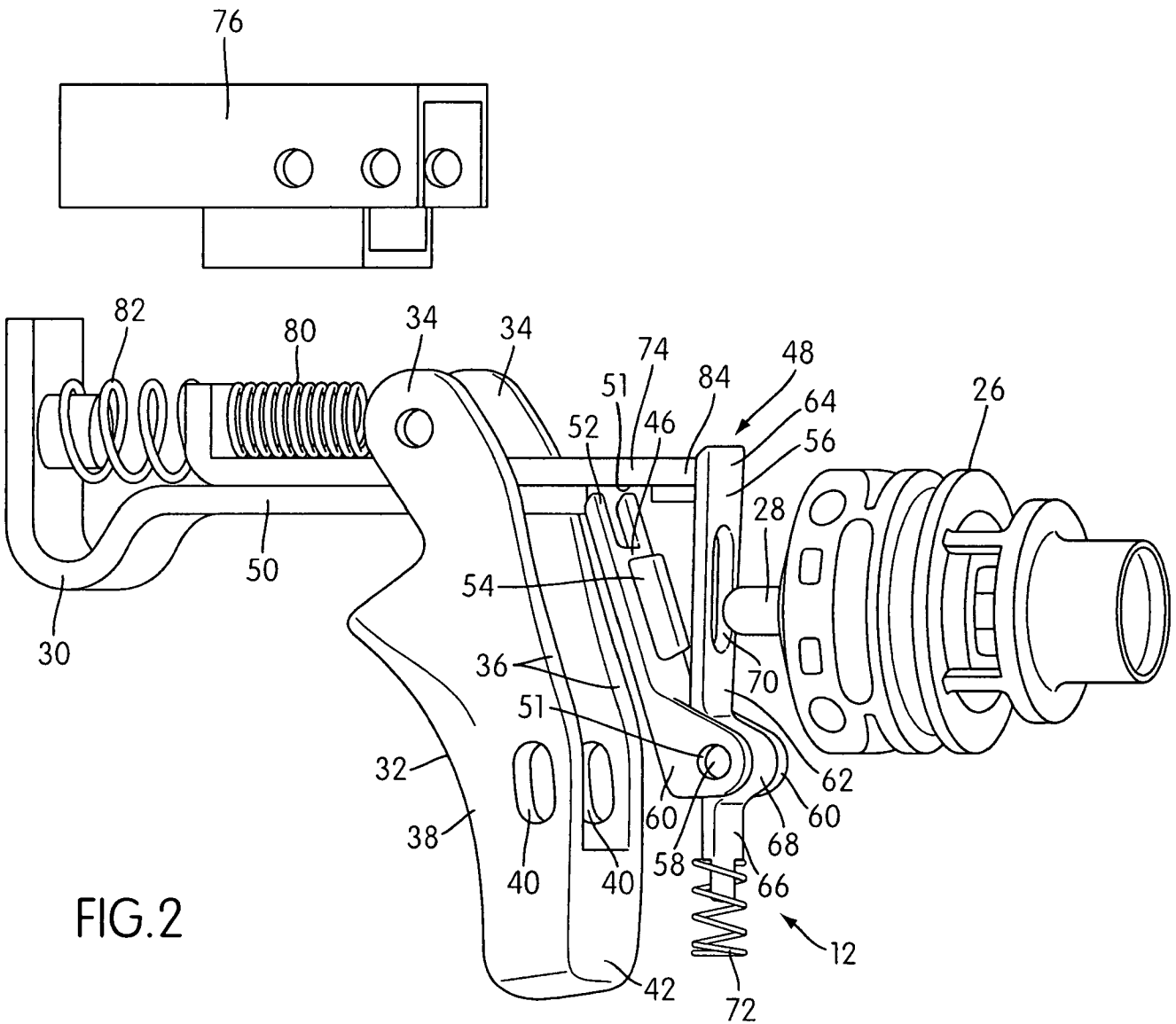
FIG. 2 is an exploded view of the trigger assembly shown in FIG. 1.
Figure 3:
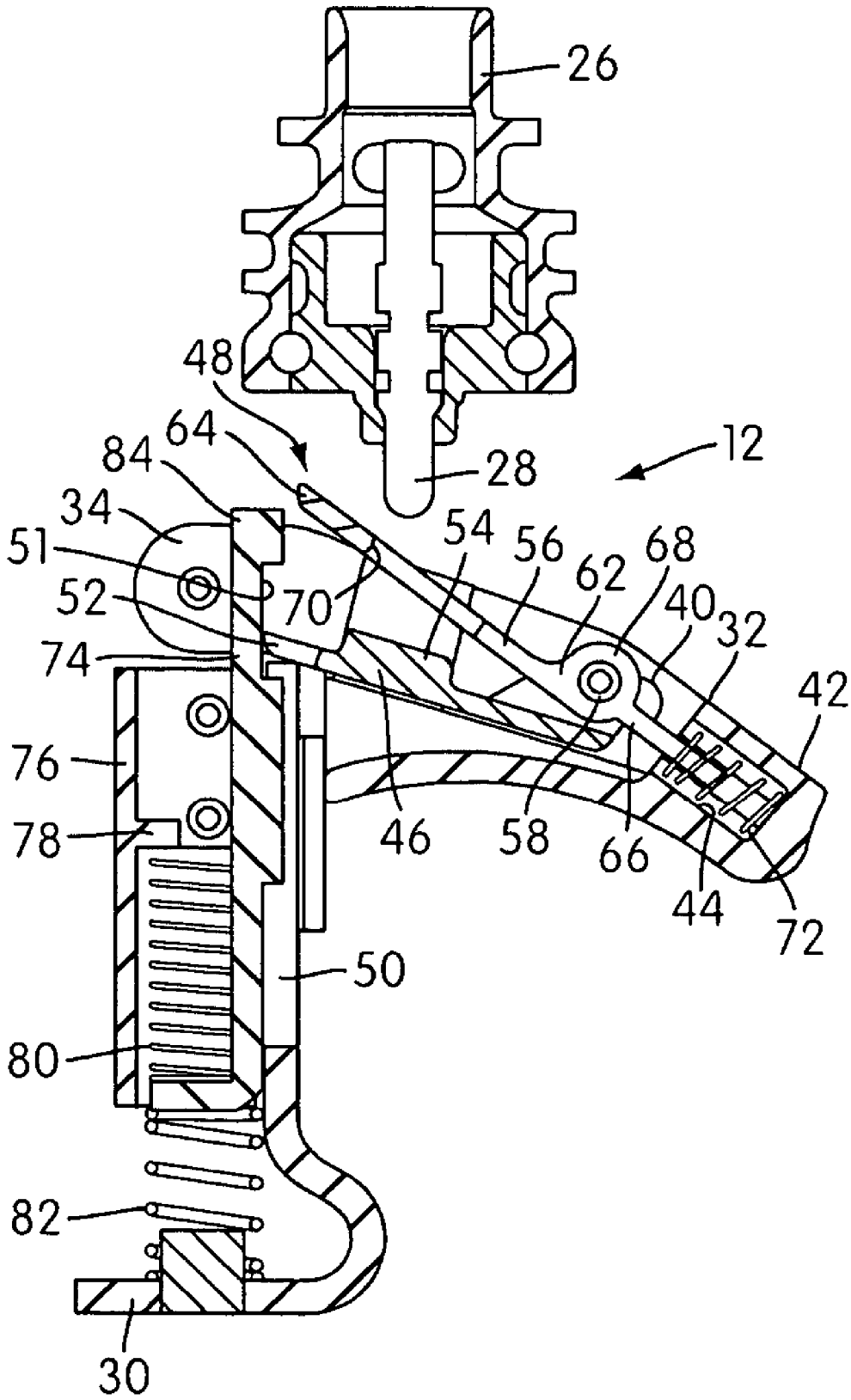
FIG. 3 is a cross-sectional view of the trigger assembly shown in FIG. 1 with the parts thereof in their normal inoperative positions.
Figure 4:
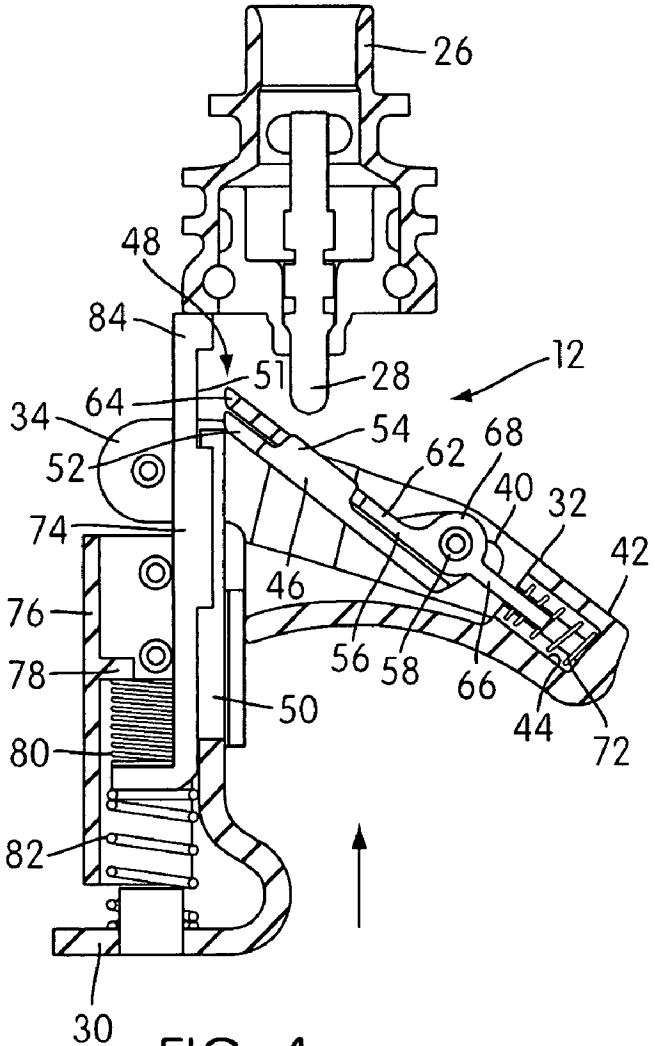
FIG. 4 is a cross-sectional view similar to FIG. 3 showing the position of the parts when the contact trip assembly has been moved into its operative position and the trigger member is in the inoperative position.
Figure 7:
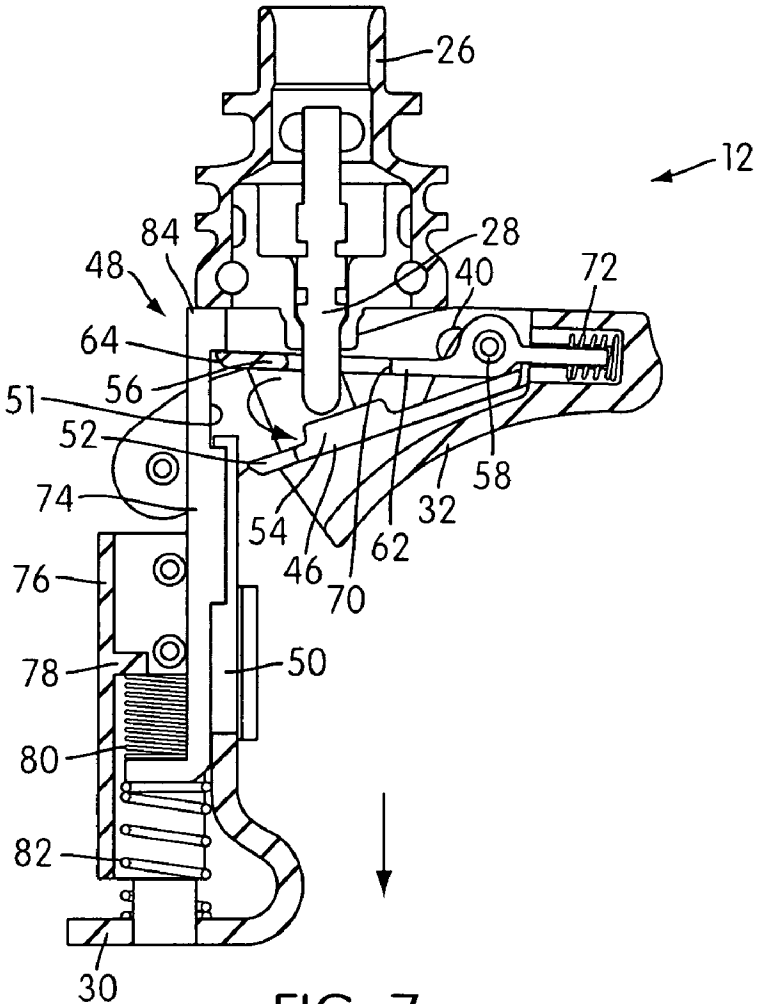
FIG. 7 is a cross-sectional view similar to FIG. 3 showing the position of the parts when the contact trip assembly moves back into its inoperative position and the trigger assembly remains in its operative position.
Figure 6:
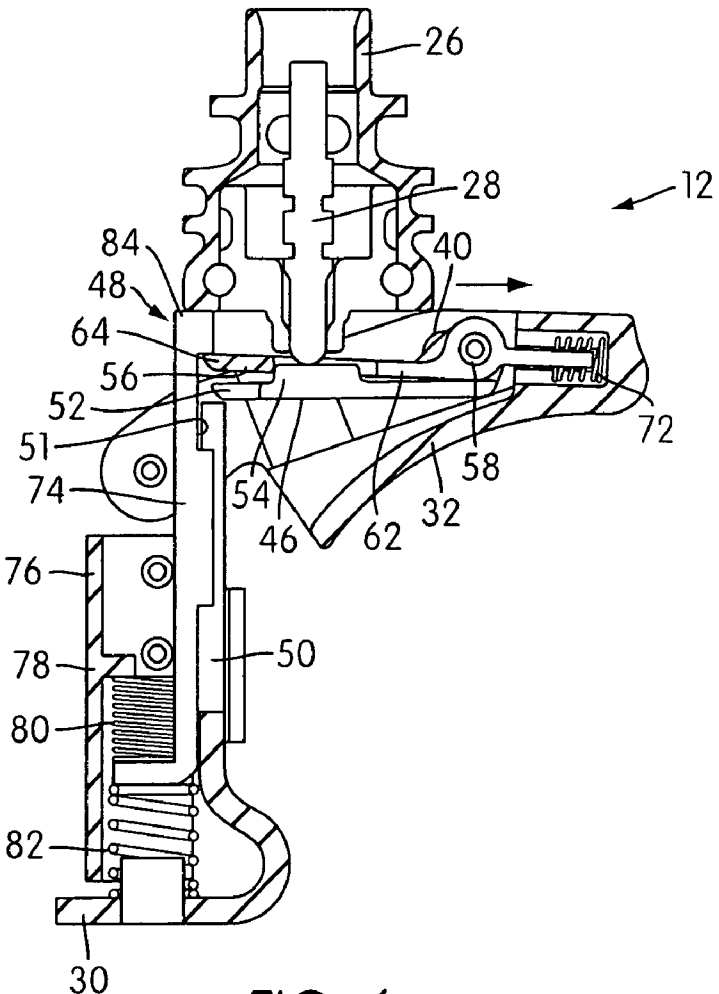
FIG. 6 is a cross-sectional view similar to FIG. 3 showing the position of the parts when the contact trip assembly is in its operative position and the trigger assembly is in its operative position.

The trigger assembly 12 is a manually operable assembly that is operatively disposed between the contact trip assembly 30 and the actuating assembly 26. As shown in FIGS. 2 and 3, the trigger assembly 12 includes a trigger member 32 which is pivoted to the frame 14. In the illustrated embodiment, the trigger member 32 includes forwardly disposed mounting portions 34 through which a pivot pin is engaged so as to mount the trigger member 32 for pivotal movement about the axis of the pivot pin between a normal inoperative position (e.g., as shown in FIGS. 3 and 4) and an operative position (e.g., as shown in FIGS. 6 and 7). The trigger member 32 is biased into its normal inoperative position by a spring which is connected between the frame 14 and the trigger member 32. In accordance with usual practice, the trigger member 32 is moved from its inoperative position into its operative position in response to digital pressure by the operator. Release of the digital pressure by the operator results in the movement of the trigger member 32 from its operative position back into its inoperative position under the action of the spring.

As best shown in FIG. 2, the trigger member 32 includes generally parallel walls 36 interconnected by a transverse wall 38 defining a U-shaped cross-sectional configuration. The parallel walls 36 each include a slot 40 therethrough. Also, as shown in FIG. 3, the end wall 42 of the trigger member 32 includes an end receiving slot 44 therein.

The trigger assembly 12 includes an actuating member 46 and an automatic mode selecting mechanism 48 that are cooperatively interrelated with the input actuator 28 of the actuating assembly 26, an output actuator 50 of the contact trip assembly 30, and the trigger member 32. The trigger assembly 12 is structured so that the device 10 may operate in either "sequential" mode or "contact" mode. The mode of operation of the device 10 depends on the sequence of activation of the trigger member 32 and the contact trip assembly 30 performed by the operator. That is, if the nose assembly 18 is initially moved into engagement with a workpiece so as to move the contact trip assembly 30 into its operative position, then the trigger assembly 12 operates in "sequential" mode. Alternatively, if the trigger member 32 is initially moved into its operative position, then the trigger assembly 12 operates in "contact" mode. Details of operation of the trigger assembly 30 will be discussed in further detail below.

The actuating member 46 has a connection with the trigger member 32 and a free end 52 cooperable with the output actuator 50 of the contact trip assembly 30. Specifically, the actuating member 46 is structured to enable a portion 54 of the actuating member 46 to engage with and move the input actuator 28 of the actuating assembly 26 into its operative position in response to movement of the contact trip assembly 30 and the trigger member 32 into the operative positions thereof. The connection of the actuating member 46 with respect to the trigger member 32 is structured to accommodate movement of the actuating member 46 with respect to the trigger member 32 between a first position and a second position, as will be further discussed.

The automatic mode selecting mechanism 48 includes a mode selecting member 56 having a connection with the actuating member 46. Specifically, the automatic mode selecting mechanism 48 is structured to make the mode selecting member 56 move with the actuating member 46 with respect to the trigger member 32 between the first and second positions of the actuating member 46, and have a relative movement with respect to the actuating member 46. That is, the actuating member 46 can move relative to the mode selecting member 56 in use.

In the illustrated embodiment, the connection of the actuating member 46 and the mode selecting member 56 together and to the trigger member 32 include a pivoting structure 58, in the form of a pivot pin. Specifically, the actuating member 46 includes spaced apart outwardly extending mounting portions 60. The mode selecting member 56 includes an elongated member 62. The elongated member 62 has a free end 64, an opposite end portion 66 slidably mounted within the end receiving slot 44 within the trigger member 32, and an outwardly extending intermediate portion 68.

The intermediate portion 68 of the elongated member 62 is received between the mounting portions 60 of the actuating member 46 with the pivoting structure 58 extending through openings 51 provided in the intermediate portion 68 and mounting portions 60. The slots 40 in the trigger member 32 are structured to receive pivot pin ends of the pivoting structure 58. The slots 40 are structured such that the actuating member 46 can move, along with the elongated member 62, linearly with respect to the trigger member 32. Also, the actuating member 46 may pivot with respect to the trigger member 32 and the elongated member 62.

That is, the pivoting structure 58 defines a pivotal axis for the actuating member 46 which is movable with respect to the trigger member 32 between spaced positions toward and away from the output actuator 50 corresponding to the first and second positions of the actuating member 46. Further, the elongated member 62 is connected with the pivoting structure 58 so as to be moved with the actuating member 46 between the first and second positions thereof.

As best shown in FIG. 2, the elongated member 62 includes an opening 70 that is structured to receive the portion 54 of the actuating member 46 therethrough to allow the portion 54 to contact and move the input actuator 28 of the actuating assembly 26 into its operative position.

The end receiving slot 44 within the trigger member 32 also receives therein a spring system 72, in the form of a compression spring. Specifically, the spring system 72 is positioned between the opposite end portion 66 of the elongated member 62 and the end wall 42 of the trigger member 32 so as to bias the elongated member 62 and the actuating member 46 into the first positions thereof. That is, the spring system 72 biases the pivoting structure 58 and the pivotal axis toward and into the position thereof toward the output actuator 50, i.e., toward the left as viewed in FIG. 3.

The pivoting structure 58 is spring biased to move the actuating member 46 toward and into the first position thereof so long as the contact trip assembly 30 is in the inoperative position thereof. The pivoting structure 58 is yieldingly movable against the spring bias to move the actuating member 46 out of the first position toward the second position thereof in response to the initial movement of the contact trip assembly 30 into the operative position thereof, as will be further discussed.

Figure 9:
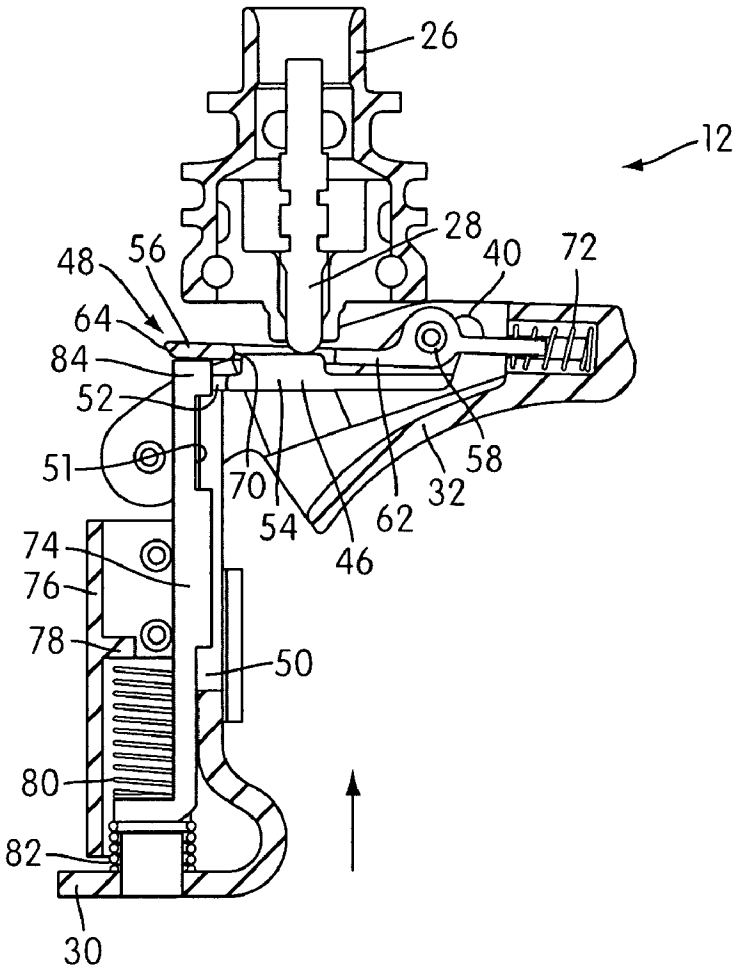
FIG. 9 is a cross-sectional view similar to FIG. 3 showing the position of the parts when the trigger assembly has been initially moved into its operative position and the contact trip assembly has been subsequently moved into its operative position.
Figure 8:
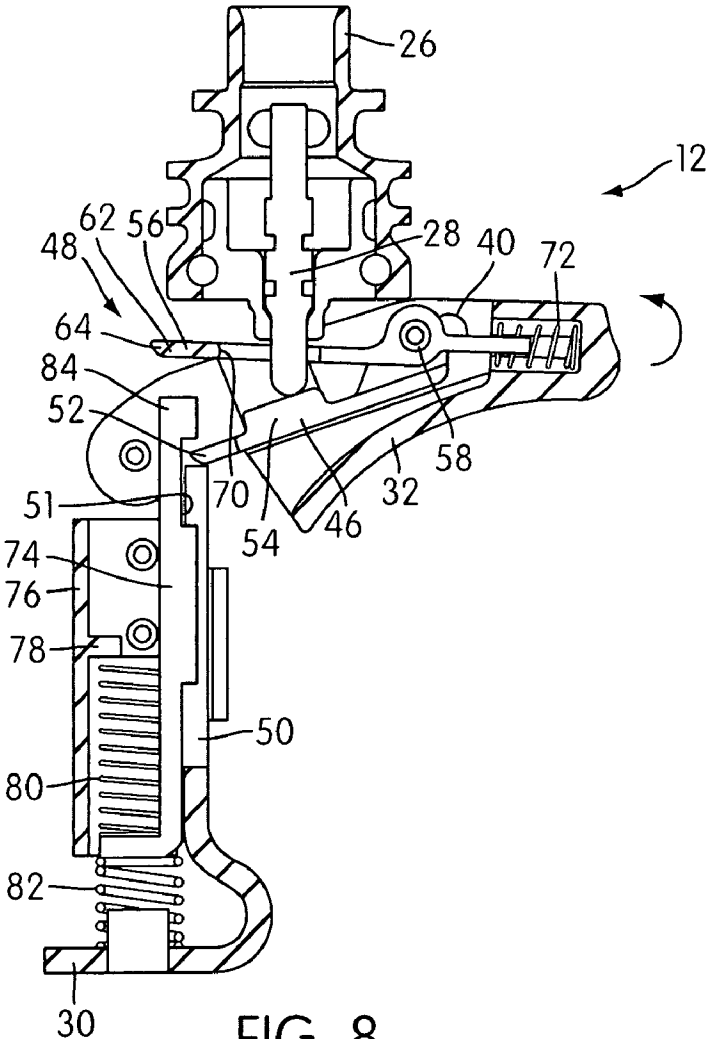
FIG. 8 is a cross-sectional view similar to FIG. 3 showing the position of the parts when the trigger assembly has been moved into its operative position and the contact trip assembly is in the inoperative position.

In the first position (as shown in FIGS. 8 and 9), the free end 52 of the actuating member 46 can be moved into a position in which the free end 52 is retained in the path of movement of the output actuator 50 following rebound or manual movement of the contact trip assembly 30 out of its operative position while the trigger member 32 is retained in its operative position following an actuating movement of the input actuator 28. That is, in the first position, the actuating member 46 can be moved into a position such that the device 10 can be operated in "contact" mode, wherein the device can be actuated every time the nose assembly is forced against the workpiece.

In the second position (as shown in FIGS. 6 and 7), the free end 52 of the actuating member 46 can be moved into a bypass position in which the free end 52 is out of the path of movement of the output actuator 50 following the rebound or manual movement of the contact trip assembly 30 out of its operative position while the trigger member 32 is retained in its operative position following an actuating movement of the input actuator 28. That is, in the second position, the actuating member 46 can be moved into a position such that the device 10 can be operated in "sequential" mode, wherein actuation of the device will only occur when the proper contact first/trigger second sequence of movement is followed.

The mode selecting member 56 can have a relative movement with respect to the actuating member 46 so that the mode selecting mechanism 48 can retain the actuating member 46 in the first position thereof in response to an initial movement of the trigger member 32 to the operative position thereof. Further, the mode selecting member 56 can have a relative movement with respect to the actuating member 46 so that the mode selecting mechanism 48 can retain the actuating member 46 in the second position thereof in response to an initial movement of the contact trip assembly 30 into the operative position thereof and a subsequent movement of the trigger member 32 into the operative position thereof. That is, the mode selecting member 56 is movable so that the mode selecting mechanism 48 can retain the actuating member 46 in the first position so that the device 10 can be operated in "contact" mode. Also, the mode selecting member 56 is movable so that the mode selecting mechanism 48 can retain the actuating member 46 in the second position so that the device 10 can be operated in "sequential" mode.

In the illustrated embodiment, the automatic mode selecting mechanism 48 also includes a mode controlling member 74 having a spring biased one way connection with the output actuator 50 of the contact trip assembly 30. This connection enables the mode controlling member 74 to move from an inoperative position into an operative position in response to an initial movement of the contact trip assembly 30 from the inoperative position thereof into the operative position thereof. This connection also enables the mode controlling member 74 and the output actuator 50 to have a relative movement with respect to one another.

Specifically, as shown in FIGS. 2 and 3, the output actuator 50 of the contact trip assembly 30 and the mode controlling member 74 of the automatic mode selecting mechanism 48 are slidably mounted within a mounting structure 76 rigidly attached to the frame 14. The mounting structure 76 includes a retaining wall 78. A first spring 80 is positioned between the retaining wall 78 of the mounting structure 76 and an upper surface of the leg of the mode controlling member 74. A second spring 82 is positioned between a lower surface of the leg of the mode controlling member 74 and an upper surface of the leg of the output actuator 50. As a result, the springs 80, 82 normally bias the output actuator 50 and the mode controlling member 74 into their inoperative positions. The output actuator 50 and the mode controlling member 74 are moveable from their normal inoperative positions into their operative positions, against biasing from the springs 80, 82, in response to movement of the device 10 into engagement with a workpiece. Also, the output actuator 50 and the mode controlling member 74 are movable relative to one another, depending on the relation of the mode controlling member 74 with respect to the elongated member 62 of the mode selecting member 56.

The mode controlling member 74 includes a projecting end portion 84 constructed and arranged to engage the free end 64 of the elongated member 62 after the actuating member 46 has assumed the second position thereof. The projecting end portion 84 prevents movement of the mode controlling member 74 from the operative position thereof and prevents movement of the actuating member 46 into the first position thereof so long as the trigger member 32 is retained in the operative position thereof, as will be further discussed.

Operation of the trigger assembly 12 will now be described in greater detail. FIG. 3 illustrates the position of the parts of the trigger assembly 12 in its normal at-rest condition prior to use. It should be noted that the trigger member 32, input actuator 28, output actuator 50, and mode controlling member 74 are biased into their respective inoperative positions. Also, the mode selecting member 56 and the actuating member 46 are biased into the first position thereof.

As aforesaid, the trigger assembly 12 is structured so that the device 10 may operate in either "sequential" mode ("place and actuate" mode) or "contact" mode. The mode of operation of the device 10 depends on the sequence of activation of the trigger member 32 and the contact trip assembly 30 performed by the operator.

To operate in "sequential" mode, the first actuating procedural step is for the operator to move the device 10 into engagement with the workpiece which is to receive the fastener. When this relationship has been established, the output actuator 50 and mode controlling member 74 move against the bias of springs 80, 82 from their normal inoperative positions thereof into their operative positions thereof, as shown in FIG. 4. During this movement, the output actuator 50 engages the free end 52 of the actuating member 46 and serves to move the actuating member 46 in a clockwise direction (as viewed in the Figures) into abutting relation with the elongated member 62 of the mode selecting member 56.

Figure 5:
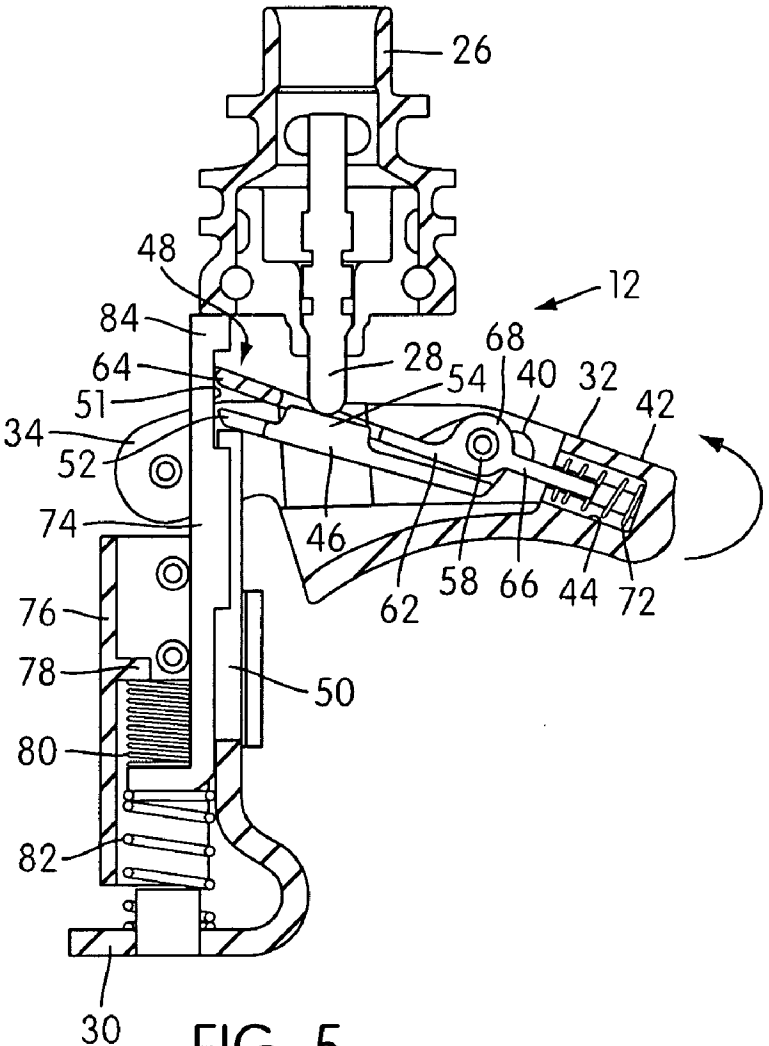
FIG. 5 is a cross-sectional view similar to FIG. 3 showing the position of the parts when the contact trip assembly has been initially moved into its operative position and the trigger assembly has been subsequently moved into its operative position.

The next procedure step in sequential actuation is for the operator to digitally effect a movement of the trigger member 32 from its normal inoperative position into the operative position thereof. During this movement, since the actuating member 46 is in engagement with the output actuator 50, the actuating member 46 will move along with the mode selecting member 56 and into engagement with the input actuator 28, as shown in FIG. 5.

As shown in FIG. 6, the mode controlling member 74, when in the operative position thereof, is disposed in the path of movement of the free end 64 of the elongated member 62 with the trigger member 32 so that the subsequent movement of the trigger member 32 into the operative position thereof after the initial movement of the contact trip assembly 30 into the operative position thereof effects a relative movement between the elongated member 62 and the trigger member 32 against the bias of spring 72. This enables the actuating member 46 to assume the second position thereof.

That is, continued movement of the trigger member 32 into its operative position will force the free end 64 of the elongated member 62 into engagement with the mode controlling member 74 which forces the elongated member 62 to move along the slots 40, against biasing from the spring system 72, from the first position thereof to the second position thereof. As a result, the actuating member 46 will move along with the elongated member 62 into the second position thereof, as shown in FIG. 6. Specifically, the free end 64 of the elongated member 62 engages a recessed portion 51 of the mode controlling member 74 which precedes the projecting end portion 84 thereof.

Moreover, continued movement of the trigger member 32 into its operative position will force the portion 54 of the actuating member 46 into the input actuator 28 and force the input actuator 28 into the operative position. This initiates the drive stroke of the fastener driving element 22 to drive the fastener which has been moved into the drive track 16 from the magazine assembly 20 outwardly through the drive track 16 and into the workpiece.

Thus, during the initial movement of the contact trip assembly 30 into the operative position thereof and the subsequent movement of the trigger member 32 into the operative position thereof, the actuating member 46 is moved into the second position thereof. As a result, the pivoting structure 58 is moved into the position thereof away from the output actuator 50 and the mode selecting member 56 is moved into a position retaining the pivoting structure 58 in the position thereof away from the output actuator 50 so long as the trigger member 32 is retained in the operative position thereof. This arrangement is such that the operator must return the trigger member 32 into its inoperative position before another actuation can take place.

Specifically, after actuation in the proper contact trip assembly first-trigger member second sequence takes place and a rebound or recoil takes place causing the contact trip assembly 30 to be momentarily returned to its normal inoperative position, this instantaneous removal of the force holding the actuating member 46 in engagement with the input actuator 28 will allow the input actuator 28 to force the actuating member 46 downwardly which in turn allows the input actuator 28 to return to its inoperative position, as shown in FIG. 7.

The free end 64 of the mode selecting member 56 is engaged with the projecting end portion 84 of the mode controlling member 74 such that the mode selecting member 56 retains the mode controlling member 74 in its operative position. Moreover, the engagement between the mode selecting member 56 and the mode controlling member 74 retains the actuating member 46 in the second position thereof so long as the trigger member 32 is retained in the operative position thereof.

This allows the actuating member 46 to move into a bypass position out of the path of movement of the contact trip assembly 30. Thus, even though the operator should retain the trigger member 32 in its operative position and then move the device 10 back into cooperating relation with the workpiece, the free end 52 of the actuating member 46 is prevented from moving into abutting relation with the output actuator 50. Thus, no actuation will occur until the trigger member 32 is released into its inoperative position and the proper sequence of movement is followed.

To operate in the "contact" mode, the first actuating procedural step is for the operator to move the trigger member 32 from its inoperative position into its operative position, as shown in FIG. 8. Because the device 10 has not been moved into engagement with the workpiece, the output actuator 50 and the mode controlling member 74 remain in their inoperative positions. During this movement, the mode selecting member 56 moves along with the trigger member 32 such that the input actuator 28 extends through the opening 70 in the mode selecting member 56. Moreover, the free end 52 of the actuating member 46 remains in abutting relation with the output actuator 50 and the portion 54 of the actuating member 46 moves into abutting relation with the input actuator 28 of the actuating assembly 26.

That is, during the initial movement of the trigger member 32 into the operative position thereof, the mode selecting member 56 is moved into a position retaining the pivoting structure 58 from moving against the bias of the spring system 72 out of the position thereof toward the output actuator 50 so long as the trigger member 32 is retained in the operative position thereof.

Thus, when the operator moves the device 10 into engagement with the workpiece, the mode controlling member 74 moves into its operative position in which it engages a bottom surface of the elongated member 62 of the mode selecting member 56, as shown in FIG. 9. Moreover, the output actuator 50 moves into its operative position which forces the portion 54 of the actuating member 46 into the input actuator 28 to force the input actuator 28 into the operative position thereof so as to initiate the drive stroke of the fastener driving element 22.

The mode controlling member 74, when in the inoperative position thereof, is out of the path of movement of the free end 64 of the elongated member 62 with the trigger member 32 that during an initial movement of the trigger member 32 into the operative position the actuating member 46 is retained in the spring biased first position thereof. That is, the free end 64 of the elongated member 62 is not forced into engagement with the mode controlling member 74, therefore, the elongated member 62 can remain in the first position thereof.

Specifically, during the initial movement of the trigger member 32 into the operative position thereof and the subsequent movement of the contact trip assembly 30 into the operative position thereof, the actuating member 46 is moved into a position so that it can remain in the first position thereof. As a result, the actuating member 46 is in the path of movement of the output actuator 50 so long as the trigger member 32 is retained in the operative position thereof. This allows the operator to retain the trigger member 32 in the operative position and move the device 10 into and out of cooperating relation with the workpiece. That is, the actuating member 46 is in a position such that the device 10 may be actuated every time the nose assembly 18 of the device 10 is forced against the workpiece.

FIGS. 10-16 illustrate another embodiment of a trigger assembly 212 for use with a fastener driving device 10.

Figure 10A:
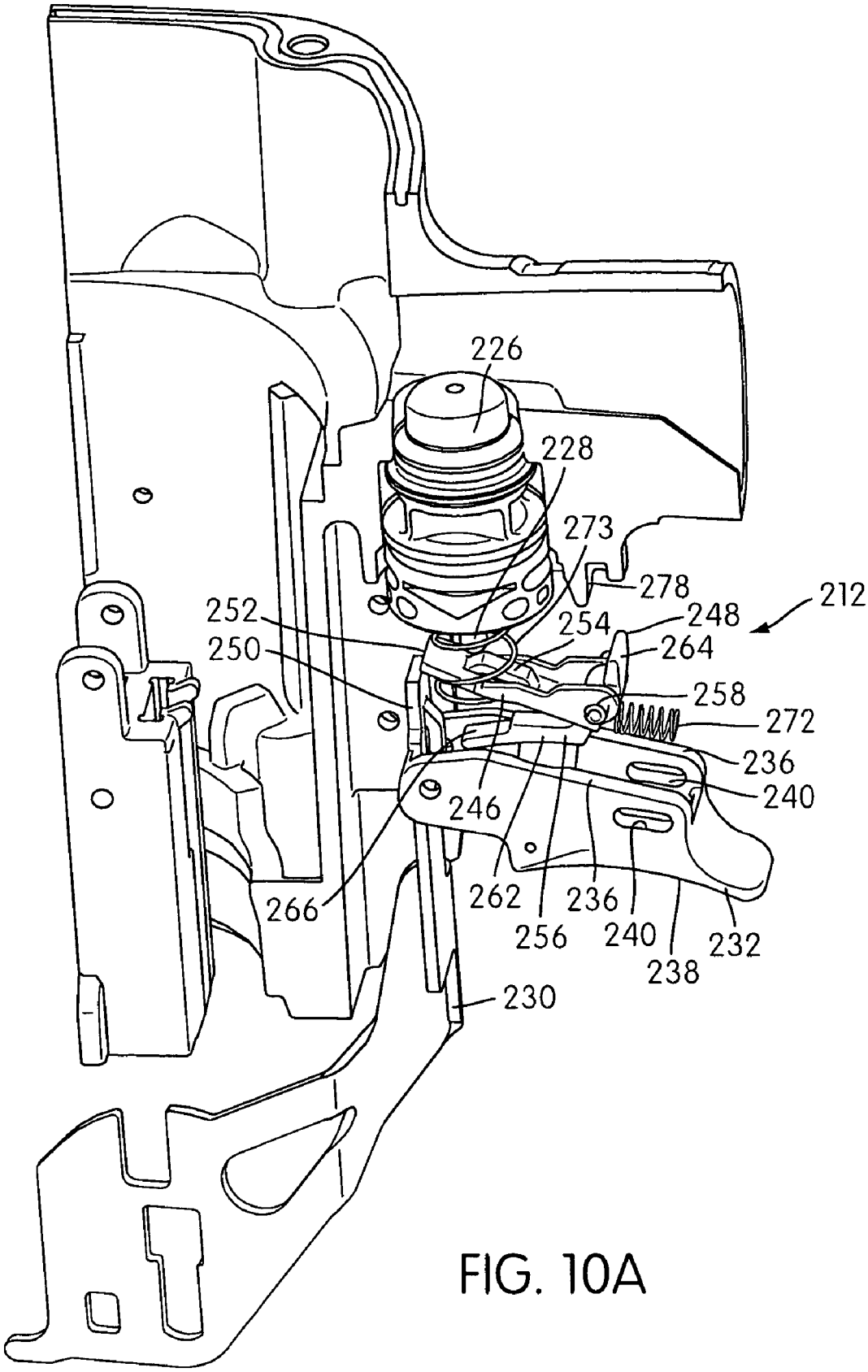
FIG. 10A is an exploded view of another embodiment of a trigger assembly.
Figure 11:
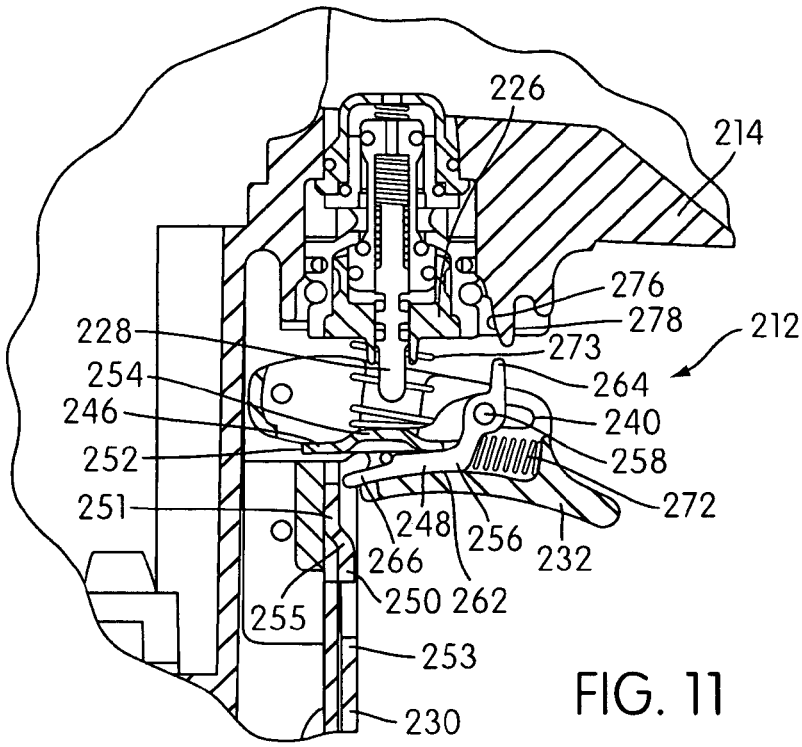
FIG. 11 is a cross-sectional view of the trigger assembly shown in FIG. 10A with the parts thereof in their normal inoperative positions.
Figure 12:
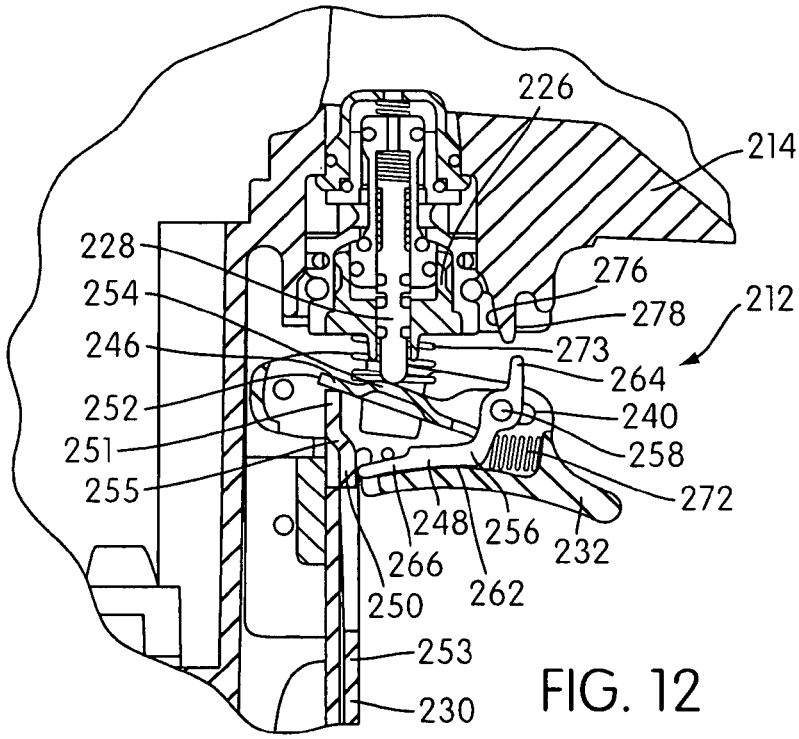
FIG. 12 is a cross-sectional view similar to FIG. 11 showing the position of the parts when the contact trip assembly has been moved into its operative position and the trigger member is in the inoperative position.
Figure 13:
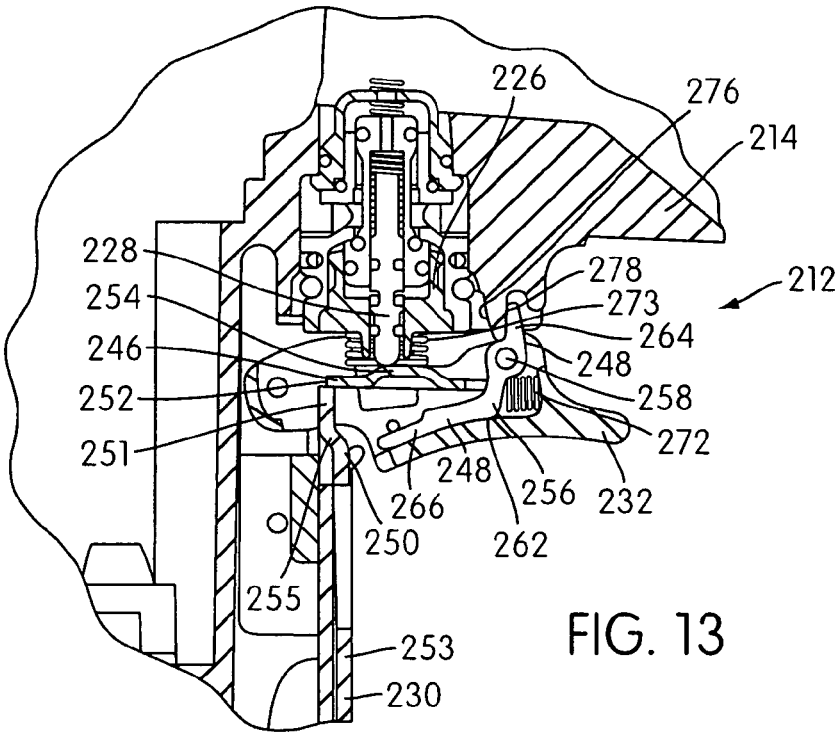
FIG. 13 is a cross-sectional view similar to FIG. 11 showing the position of the parts when the contact trip assembly has been initially moved into its operative position and the trigger assembly has been subsequently moved into its operative position.
Figure 14:
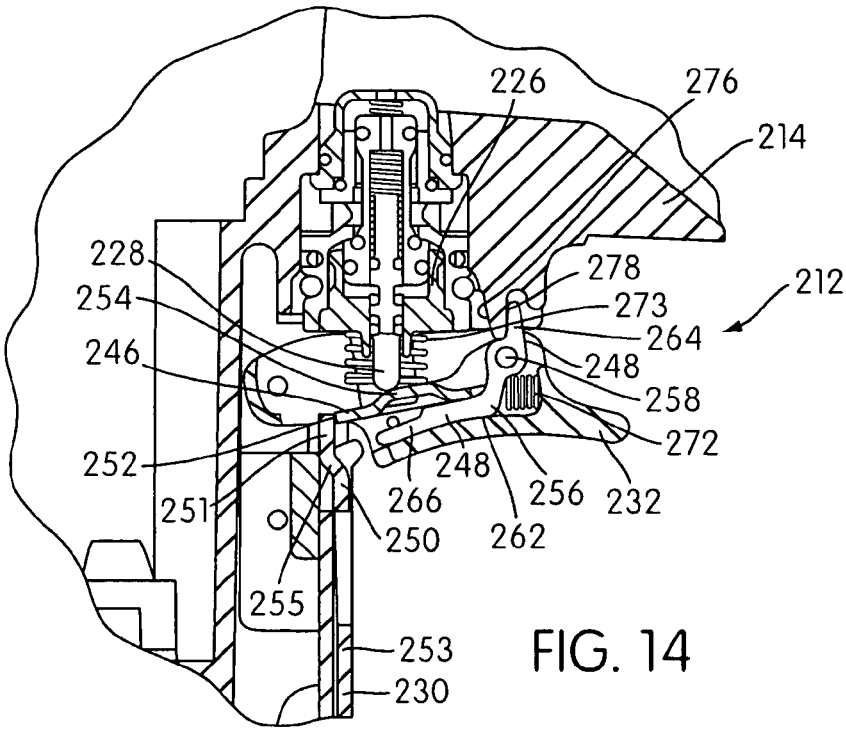
FIG. 14 is a cross-sectional view similar to FIG. 11 showing the position of the parts when the contact trip assembly moves back into its inoperative position and the trigger assembly remains in its operative position.

As shown in FIGS. 10A and 11, the trigger assembly 212 is operatively connected between the contact trip assembly 230 and the actuating assembly 226. The trigger assembly 212 includes a trigger member 232 which is pivoted to the frame 214 for pivotal movement between a normal inoperative position (e.g., as shown in FIGS. 11 and 12) and an operative position (e.g., as shown in FIGS. 13 and 14). The trigger member 232 is biased into its normal inoperative position by a spring which is connected between the frame 214 and the trigger member 232.

Figure 10B:
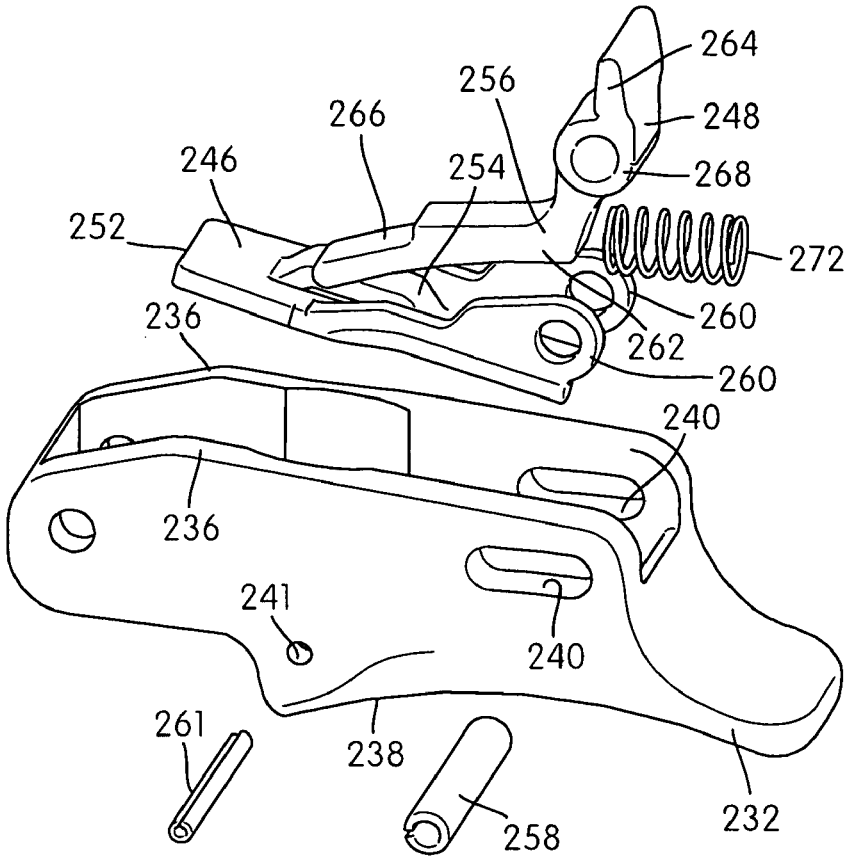
FIG. 10B is an enlarged exploded view of the trigger assembly shown in FIG. 10A.
Figure 10C:
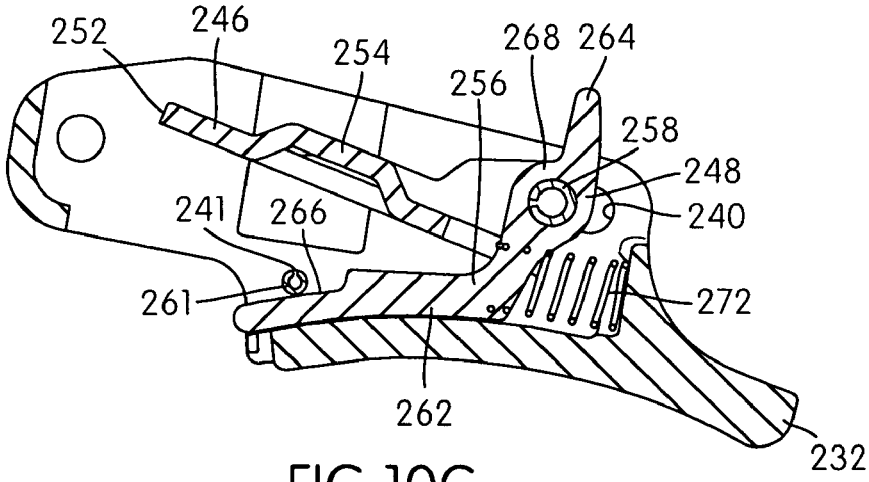
FIG. 10C is a cross-section view of the trigger assembly shown in FIG. 10A.

As best shown in FIGS. 10A-10C, the trigger member 232 includes generally parallel walls 236 interconnected by a transverse wall 238 defining a U-shaped cross-sectional configuration. The parallel walls 236 each include a slot 240 therethrough and an opening 241 therethrough.

The trigger assembly 212 includes an actuating member 246 and an automatic mode selecting mechanism 248 that are cooperatively interrelated with an input actuator 228 of the actuating assembly 226, an output actuator 250 of the contact trip assembly 230, the trigger member 232, and the frame 214. Similar to the trigger assembly 12, the trigger assembly 212 is structured so that the device may operate in either "sequential" mode or "contact" mode. The mode of operation of the device depends on the sequence of activation of the trigger member 232 and the contact trip assembly 230 performed by the operator.

The actuating member 246 has a connection with the trigger member 232 and a free end 252 cooperable with the output actuator 250 of the contact trip assembly 230. Specifically, the actuating member 246 is structured to enable a portion 254 of the actuating member 246 to move the input actuator 228 of the actuating assembly 226 into its operative position in response to movement of the contact trip assembly 230 and the trigger member 232 into the operative positions thereof. The connection of the actuating member 246 with respect to the trigger member 232 is structured to accommodate movement of the actuating member 246 with respect to the trigger member 232 between a first position and a second position, as will be further discussed.

The automatic mode selecting mechanism 248 includes a mode selecting member 256 having a connection with the actuating member 246. Specifically, the automatic mode selecting mechanism 248 is structured to make the mode selecting member 256 move with the actuating member 246 with respect to the trigger member 232 between the first and second positions of the actuating member 246, and have a relative movement with respect to the actuating member 246.

In the illustrated embodiment, the connection of the actuating member 246 and the mode selecting member 256 together and to the trigger member 232 include a pivoting structure 258, in the form of a pivot pin. Specifically, the actuating member 246 includes spaced apart outwardly extending mounting portions 260. The mode selecting member 256 includes a bell crank lever 262 having a first arm 264 cooperable with the frame 214, a second arm 266 cooperable with the output actuator 250, and an intermediate mounting portion 268.

The intermediate mounting portion 268 of the bell crank lever 262 is received between the mounting portions 260 of the actuating member 246 with the pivoting structure 258 extending through openings provided in the intermediate mounting portion 268 and mounting portions 260. The slots 240 in the trigger member 232 are structured to receive pivot pin ends of the pivoting structure 258. The slots 240 are structured such that the actuating member 246 can move, along with the bell crank lever 262, linearly with respect to the trigger member 232. Also, the actuating member 246 may pivot with respect to the trigger member 232 and the bell crank lever 262.

That is, the pivoting structure 258 defines a pivotal axis for the actuating member 246 which is movable with respect to the trigger member 232 between spaced positions toward and away from the output actuator 250 corresponding to the first and second positions of the actuating member 246. Further, the bell crank lever 262 is connected with the pivoting structure 258 so as to be moved with the actuating member 246 between the first and second positions thereof.

Specifically, the bell crank lever 262 is pivoted by the pivoting structure 258 which defines a common pivotal axis for the bell crank lever 262 and the actuating member 246. However, a pin 261 is mounted between the openings 241 in the trigger member 232. The pin 261 is slidably engaged with the second arm 266 of the bell crank lever 262 to prevent pivotal movement of the bell crank lever 262 but allow linear sliding movement with respect to the trigger member 232. That is, the common pivotal axis is movable with respect to the trigger member 232 which enables the bell crank lever 262 and the actuating member 246 to be moved together between the first and second positions thereof.

A spring system, in the form of first spring 272, is positioned between the bell crank lever 262 and the end wall 242 of the trigger member 232 so as to bias the bell crank lever 262 and the actuating member 246 into the first positions thereof. Thus, the spring system 272 biases the pivoting structure 258 and the pivotal axis toward and into the position thereof toward the output actuator 250, i.e., toward the left as viewed in FIG. 11.

Specifically, the bell crank lever 262 has the first spring 272 acting thereon yieldably biasing the bell crank lever 262 in a direction to move the actuating member 246 into the first position thereof. The actuating member 246 also has a second spring 273 yieldably biasing the actuating member 246 to pivot in a counterclockwise direction. The second spring 273 acts on the actuating member 246 to force the actuating member 246 in a direction away from the input actuator 228.

That is, the pivoting structure 258 is spring biased to move the actuating member 246 toward and into the first position thereof so long as the contact trip assembly 230 is in the inoperative position thereof. The pivoting structure 258 is yieldingly movable against the spring bias to move the actuating member 246 out of the first position toward the second position thereof in response to the initial movement of the contact trip assembly 230 into the operative position thereof, as will be further discussed.

In the first position, the free end 252 of the actuating member 246 can be moved into a position in which the free end 252 is retained in the path of movement of the output actuator 250 following rebound or manual movement of the contact trip assembly 230 out of its operative position while the trigger member 232 is retained in its operative position following an actuating movement of the input actuator 228. That is, in the first position, the actuating member 246 can be moved into a position such that the device can be operated in "contact" mode.

In the second position, the free end 252 of the actuating member 246 can be moved into a bypass position in which the free end 252 is out of the path of movement of the output actuator 250 following the rebound or manual movement of the contact trip assembly 230 out of its operative position while the trigger member 232 is retained in its operative position following an actuating movement of the input actuator 228. That is, in the second position, the actuating member 246 can be moved into a position such that the device can be operated in "sequential" mode.

The mode selecting member 256 is movable relative to the actuating member 246 so that the mode selecting mechanism 248 can retain the actuating member 246 in the first position thereof in response to an initial movement of the trigger member 232 to the operative position thereof. Further, the mode selecting member 256 is movable relative to the actuating member 246 so that the mode selecting mechanism 248 can retain the actuating member 246 in the second position thereof in response to an initial movement of the contact trip assembly 230 into the operative position thereof and a subsequent movement of the trigger member 232 into the operative position thereof. That is, the mode selecting member 256 is movable so that the mode selecting mechanism 248 can retain the actuating member 246 in the first position so that the device can be operated in "contact" mode. Also, the mode selecting member 256 is movable so that the mode selecting mechanism 248 can retain the actuating member 246 in the second position so that the device can be operated in "sequential" mode.

In the illustrated embodiments, the first arm 264 of the bell crank lever 262 is cooperatable with the frame 214 so that after the trigger member 232 has been initially moved into the operative position thereof, the bell crank lever 262 is retained against movement in a first position and is operable to retain the actuating member 246 in the first position thereof so long as the trigger member 232 is retained in the operative position thereof. Also, the first arm 264 of the bell crank lever 262 is cooperatable with the frame 214 so that after the trigger member 232 has been subsequently moved into the operative position thereof following an initial movement of the contact trip assembly 230 into the operative position thereof, the bell crank lever 262 is retained against movement in a second position and is operable to retain the actuating member 246 in the second position thereof so long as the trigger member 232 is retained in the operative position thereof.

Specifically, in the embodiment illustrated in FIGS. 11-16, the automatic mode selecting mechanism 248 includes a first surface 276 on the frame 214 slidably cooperating with the first arm 264 and cooperating with the mounting of the bell crank lever 262 with respect to the trigger member 232 to prevent movement of the bell crank lever 262 and the actuating member 246 when the actuating member 246 is in the first position thereof and the trigger member 232 is initially moved into the operative position thereof. The automatic mode selecting mechanism 248 also includes a second surface 278 on the frame 214 in spaced relation to the first surface 276 slidably cooperating with the first arm 264 and cooperating with the mounting of the bell crank lever 262 with respect to the trigger member 232 to prevent movement of the bell crank lever 262 and the actuating member 246 when the actuating member 246 is in the second position thereof by virtue of the initial movement of the contact trip assembly 230 into the operative position thereof. As illustrated, the first surface 276 and the second surface 278 are integral with the frame 214.

In the embodiment illustrated in FIGS. 17-22, FIGS. 17-22 substantially corresponding to FIGS. 11-16, respectively, the automatic mode selecting mechanism 248 includes a first surface 376 that is provided on an arm engaging member 300 that is connected to the frame 214. Thus, it is understood that in this embodiment, the first arm 264 of the bell crank lever 262 may still be considered to be cooperatable with the frame 214, as the arm engaging member 300 may be considered to be part of the frame 214 when it is connected to the frame 214. The first surface 376 on the arm engaging member 300 slidably cooperates with the first arm 264 and cooperates with the mounting of the bell crank lever 262 with respect to the trigger member 232 to prevent movement of the bell crank lever 262 and the actuating member 246 when the actuating member 246 is in the first position thereof. The automatic mode selecting mechanism 248 also includes a second surface 378 on the arm engaging member 300 in spaced relation to the first surface 376 that slidably cooperates with the first arm 264 and cooperates with the mounting of the bell crank lever 262 with respect to the trigger member 232 to prevent movement of the bell crank lever 262 and the actuating member 246 when the actuating member 256 is in the second position thereof by virtue of the initial movement of the contact trip assembly 230 into the operative position thereof. In this embodiment, the first arm 264 may be more pointed at its end, as compared to the first arm 264 of the embodiment illustrated in FIGS. 11-16. Of course, the end of the first arm 264 may have any shape, so long as a camming action is created between the first arm 264 and the second surface 378.

The arm engaging member 300 is a separate component that may be connected to the frame 214 by any type of connected that allows the arm engaging member 300 to be rigidly connected to the frame 214. For example, the arm engaging member 300 may include threads 302 and the frame 214 may include matching threads 304 so that the arm engaging member 300 may be screwed into the frame 214. Alternatively, or additionally, the arm engaging member 300 may be connected to the frame 214 with a pin 306 that may be removed so that the arm engaging member 300 may be removed from the frame 214 and replaced with another arm engaging member, or any other piece. The arm engaging member 300 may be made from steel or any other wear resistant material. Preferably, the arm engaging member 300 is made from a material that is more wear resistant than the frame 214. The arm engaging member 300 may be of any general shape, as long as the first surface 376 and the second surface 378 are positioned to cooperate with the first arm 264 in the manner described above. The illustrated embodiment is not intended to be limiting.

Operation of the trigger assembly 212 will now be described in greater detail in regard to the embodiment illustrate in FIGS. 11-16. It is understood that where the first and second surfaces 276, 278 of the frame are referenced, the first and second surfaces 376, 378 of the arm engaging member 300 may be substituted.

FIG. 11 illustrates the position of the parts of the trigger assembly 212 in its normal at-rest condition prior to use. It should be noted that the trigger member 232, input actuator 228, and output actuator 250 are biased into their respective inoperative positions. Also, the mode selecting member 256 and the actuating member 246 are biased into the first position thereof.

To operate in "sequential" mode, the first actuating procedural step is for the operator to move the device into engagement with the workpiece which is to receive the fastener. When this relationship has been established, the output actuator 250 moves from its normal inoperative position thereof into its operative position thereof, as shown in FIG. 12. During this movement, the free end of the output actuator 250 engages the free end 252 of the actuating member 246 and serves to move the actuating member 246, against biasing from the second spring 273, in a clockwise direction such that the portion 254 of the actuating member 246 moves into abutting relation with the input actuator 228.

Moreover, the output actuator 250 has a ramped configuration such that the output actuator 250 is disposed in the path of movement of the second arm 266 of the bell crank lever 262 when the output actuator 250 is moved to its operative position. Specifically, the output actuator 250 has a first portion 251, a second portion 253 offset from the first portion 251, and a ramped intermediate portion 255 that interconnects the first and second portions 251, 253. This configuration of the output actuator 250 enables the output actuator 250 to force the bell crank 262 from the first position to the second position in use. That is, the initial movement of the contact trip assembly 30 into the operative position thereof causes the ramped portion 255 of the output actuator 250 to engage the second arm 266 of the bell crank lever 262 and serves to force the bell crank lever 262 along with the actuating member 246 from the first position thereof towards the second position thereof, against biasing from the first spring 272. This moves the first arm 264 of the bell crank lever 262 into alignment with the second surface 278 on the frame 214.

The next procedure step in sequential actuation is for the operator to digitally effect a movement of the trigger member 232 from its normal inoperative position into the operative position thereof, as shown in FIG. 13. As the trigger member 232 reaches the operative position, the first arm 264 of the bell crank lever 262 engages the second surface 278 on the frame 214. The engagement between the first arm 264 and the second surface 278 retains the bell crank lever 262 and the actuating member 246 in the second position thereof so long as the trigger member 232 is retained in the operative position thereof. Further, movement of the trigger member 232 into its operative position will force the portion 254 of the actuating member 246 into the input actuator 228 and force the input actuator 228 into the operative position. This initiates the drive stroke of the fastener driving element.

Thus, during the initial movement of the contact trip assembly 230 into the operative position thereof and the subsequent movement of the trigger member 232 into the operative position thereof, the actuating member 246 is moved into the second position thereof. As a result, the pivoting structure 258 is moved into the position thereof away from the output actuator 250 and the mode selecting member 256 is moved into a position retaining the pivoting structure 258 in the position thereof away from the output actuator 250 so long as the trigger member 232 is retained in the operative position thereof. This arrangement is such that the operator must return the trigger member 232 into its inoperative position before another actuation can take place.

Specifically, after actuation in the proper contact trip assembly first-trigger member second sequence takes place and a rebound or recoil takes place causing the contact trip assembly 230 to be momentarily returned to its normal inoperative position, this instantaneous removal of the force holding the actuating member 246 in engagement with the input actuator 228 will allow the input actuator 228, along with the second spring 273, to force the actuating member 246 downwardly which in turn allows the input actuator 228 to return to its inoperative position, as shown in FIG. 14. The bell crank lever 262 is engaged with the second surface 278 on the frame to retain the bell crank lever 262 and the actuating member 246 in the second position thereof.

This allows the actuating member 246 to move into a bypass position out of the path of movement of the contact trip assembly 230. The drive stroke of the device is now complete and the operator has to restart the sequence of movement. Thus, even though the operator should retain the trigger member 232 in its operative position and then move the device back into cooperating relation with the workpiece, the free end 252 of the actuating member 246 is prevented from moving into engagement with the free end of the output actuator 250. Thus, no actuation will occur until the trigger member 232 is released into its inoperative position and the proper sequence of movement is followed.

Figure 15:
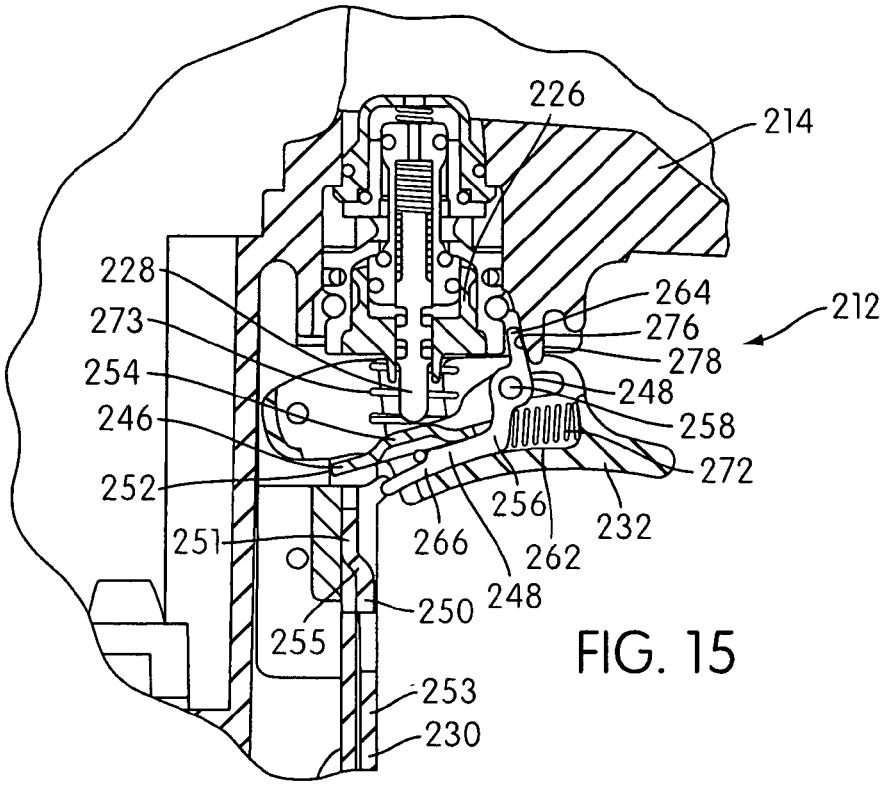
FIG. 15 is a cross-sectional view similar to FIG. 11 showing the position of the parts when the trigger assembly has been moved into its operative position and the contact trip assembly is in the inoperative position.
Figure 16:
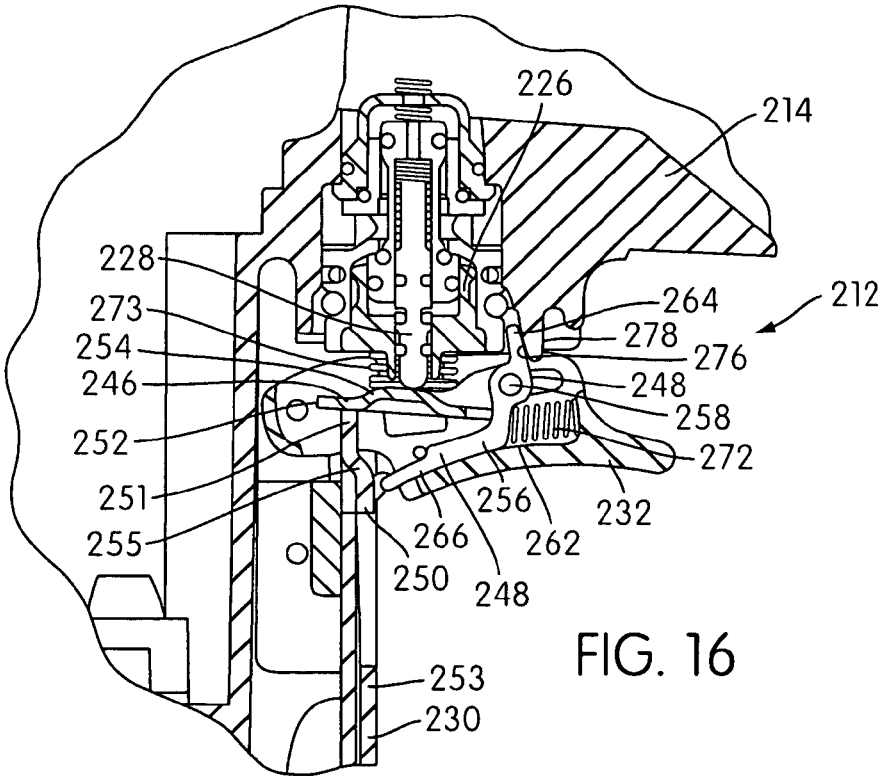
FIG. 16 is a cross-sectional view similar to FIG. 11 showing the position of the parts when the trigger assembly has been initially moved into its operative position and the contact trip assembly has been subsequently moved into its operative position.
Figure 17:
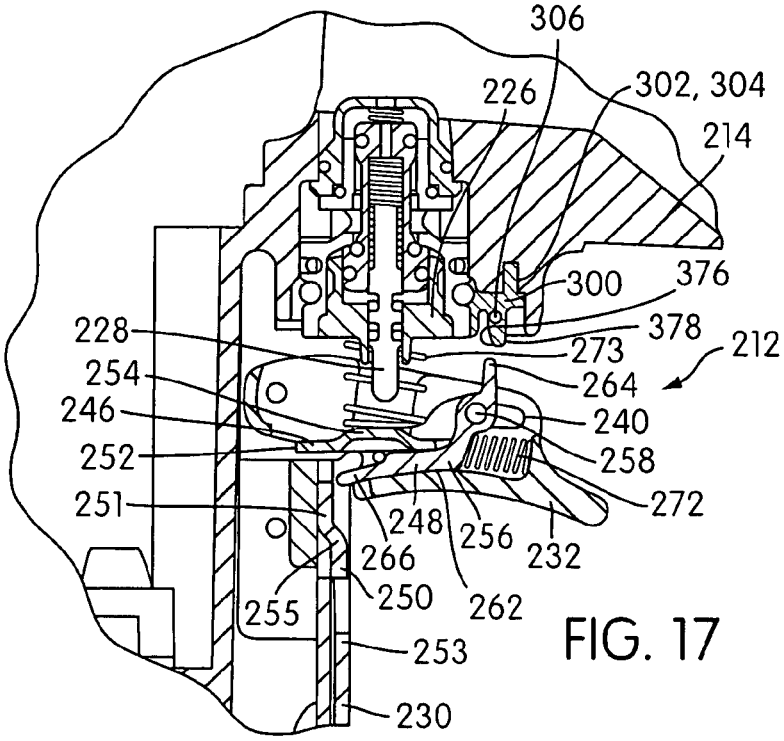
FIG. 17 is a cross-sectional view of another embodiment of the trigger assembly of the present invention with the parts thereof in their normal inoperative positions.
Figure 18:
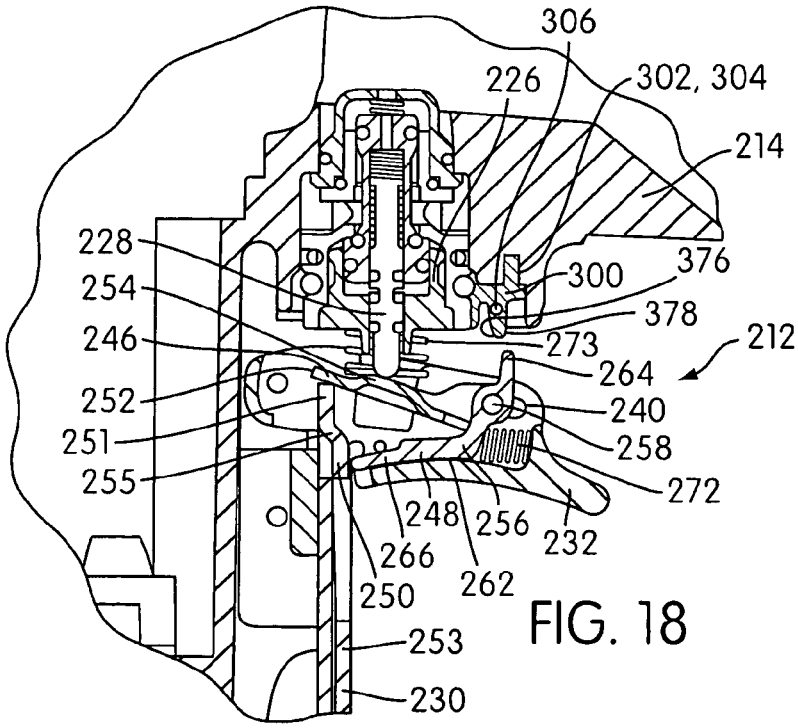
FIG. 18 is a cross-sectional view similar to FIG. 17 showing the position of the parts when the contact trip assembly has been moved into its operative position and the trigger member is in the inoperative position.
Figure 19:
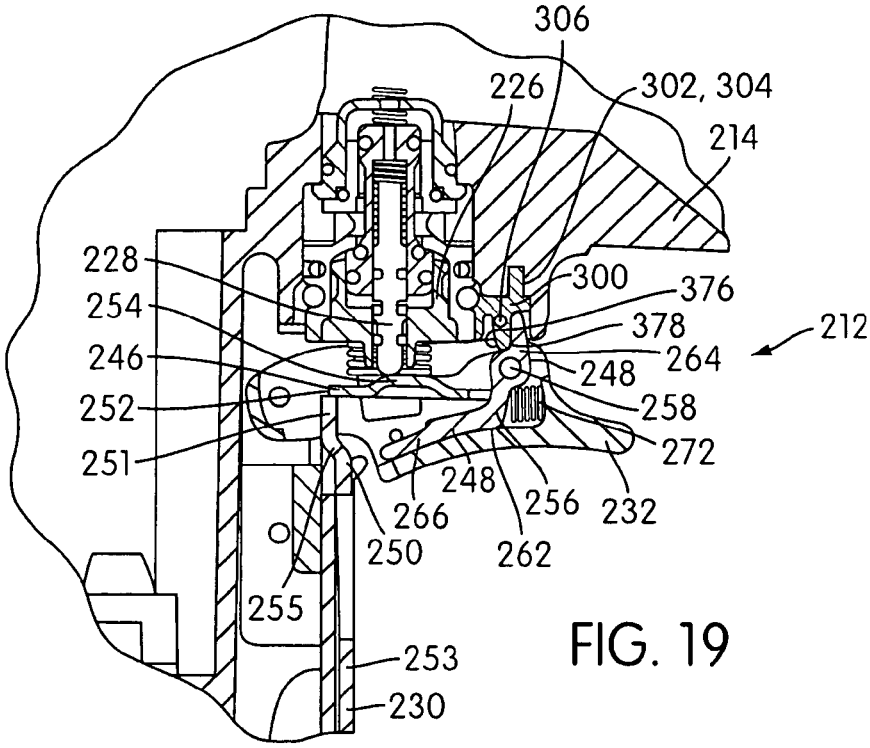
FIG. 19 is a cross-sectional view similar to FIG. 17 showing the position of the parts when the contact trip assembly has been initially moved into its operative position and the trigger assembly has been subsequently moved into its operative position.
Figure 20:
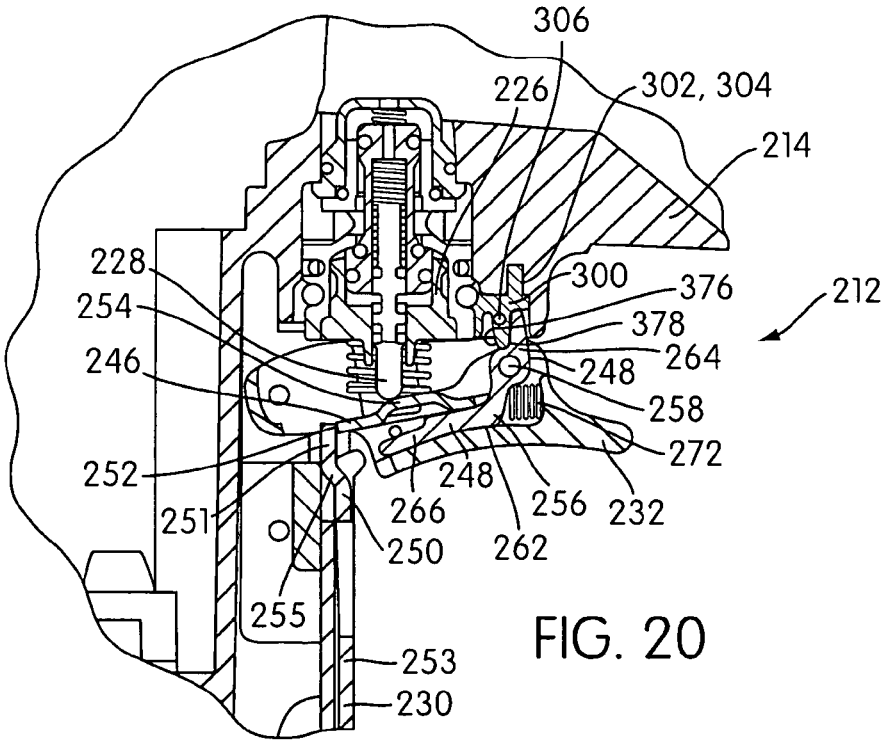
FIG. 20 is a cross-sectional view similar to FIG. 17 showing the position of the parts when the contact trip assembly moves back into its inoperative position and the trigger assembly remains in its operative position.
Figure 21:
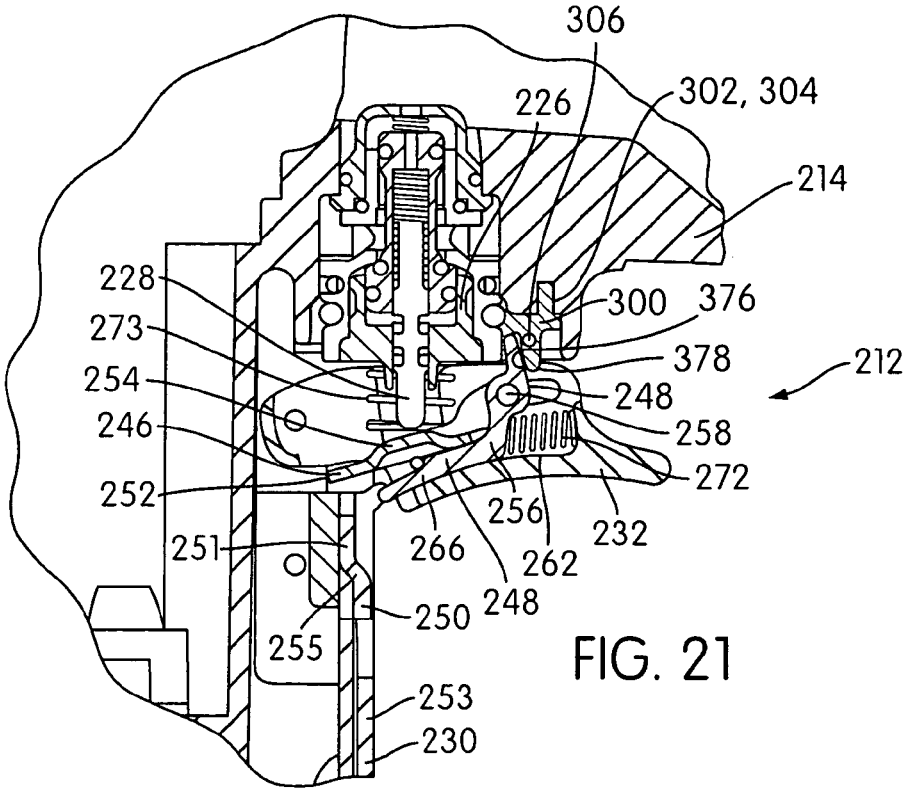
FIG. 21 is a cross-sectional view similar to FIG. 17 showing the position of the parts when the trigger assembly has been moved into its operative position and the contact trip assembly is in the inoperative position.
Figure 22:
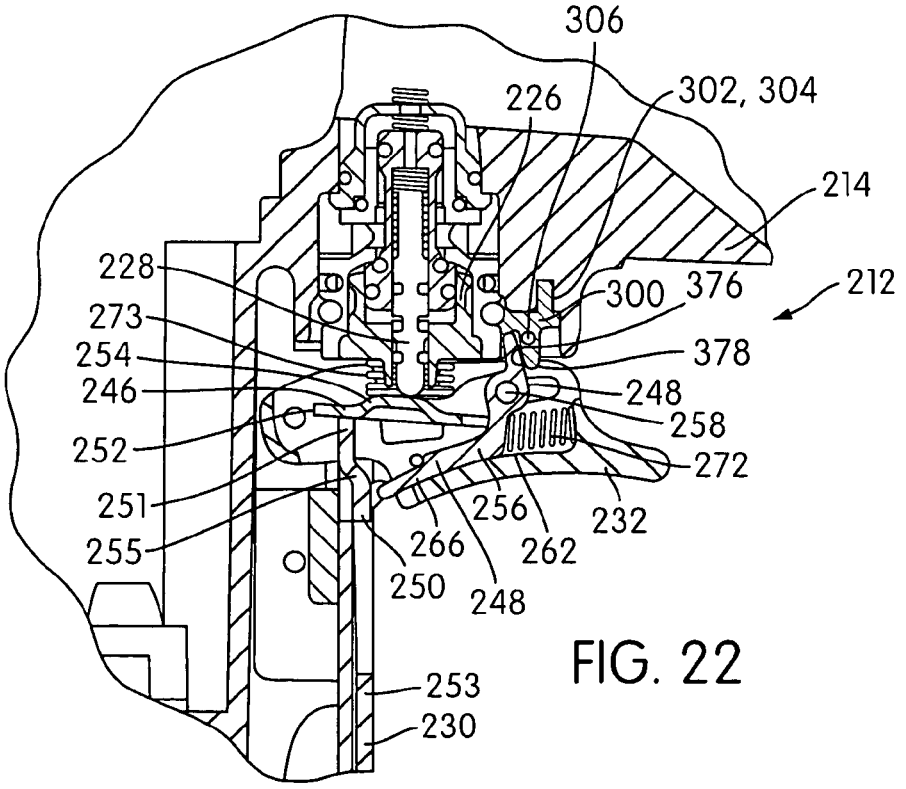
FIG. 22 is a cross-sectional view similar to FIG. 17 showing the position of the parts when the trigger assembly has been initially moved into its operative position and the contact trip assembly has been subsequently moved into its operative position.

To operate in the "contact" mode, the first actuating procedural step is for the operator to move the trigger member 232 from its inoperative position into its operative position, as shown in FIG. 15. Because the device has not been moved into engagement with the workpiece, the output actuator 250 remains in its inoperative position. Further, the mode selecting member 256 and the actuating member 246 are biased into the first position thereof.

During this movement, the portion 254 of the actuating member 246 moves into abutting relation with the input actuator 228. Moreover, as the trigger member 232 reaches the operative position, the first arm 264 of the bell crank lever 262 engages the first surface 276 on the frame 214, as shown in FIG. 15. The engagement between the first arm 264 and the first surface 276 retains the bell crank lever 262 and the actuating member 246 in the first position thereof so long as the trigger member 232 is retained in the operative position thereof.

That is, during the initial movement of the trigger member 232 into the operative position thereof, the bell crank lever 262 is moved into a position retaining the pivoting structure 258 from moving against the bias of the first spring 272 out of the position thereof toward the output actuator 250 so long as the trigger member 232 is retained in the operative position thereof.

Thus, when the operator moves the device into engagement with the workpiece, the output actuator 250 moves into its operative position which forces the free end of the output actuator 250 into engagement with the actuating member 246. As a result, the portion 254 of the actuating member 246 is forced into the input actuator 228, against biasing from the second spring 273, to force the input actuator 228 into the operative position thereof so as to initiate the drive stroke of the fastener driving element.

The bell crank lever 262 is out of the path of movement of the output actuator 250 so that during an initial movement of the trigger member 232 into the operative position the actuating member 246 is retained in the spring biased first position thereof. That is, the bell crank lever 262 is not forced into engagement with the output actuator 250, therefore, the bell crank lever 262 can remain in the first position thereof along with the actuating member 246.

Specifically, during the initial movement of the trigger member 232 into the operative position thereof and the subsequent movement of the contact trip assembly 230 into the operative position thereof, the actuating member 246 is moved into a position so that it can remain in the first position thereof. As a result, the actuating member 246 is in the path of movement of the output actuator 250 so long as the trigger member 232 is retained in the operative position thereof. This allows the operator to retain the trigger member 232 in the operative position and move the device into and out of cooperating relation with the workpiece. That is, the actuating member 246 is in a position such that the device may be actuated every time the nose assembly of the device is forced against the workpiece.

Operation of the trigger assemblies 12, 212 is such that the parts thereof do not require substantially high tolerances. That is, the trigger assemblies 12, 212 are not substantially tolerant sensitive. As a result, lower tolerance parts do not have a substantially adverse effect on operation of the trigger assemblies 12, 212.

It can thus be appreciated that the aspects of the present invention have now been fully and effectively accomplished. The foregoing specific embodiments have been provided to illustrate the structural and functional principles of the present invention, and are not intended to be limiting. To the contrary, the present invention is intended to encompass all modifications, alterations and substitutions within the spirit and scope of the appended claims.

What is claimed is:

1. A method for operating a fastener driving device, the method comprising:

moving an input actuator of an actuating assembly into an operative position in response to movement of a contact trip assembly and a trigger member into the operative positions thereof, said contact trip assembly having an output actuator;

moving an actuating member with respect to said trigger member between (1) a first position wherein a portion of said actuating member is moved into a position in which the portion is retained in the path of movement of the output actuator following rebound or manual movement of the contact trip assembly out of its operative position while said trigger member is retained in its operative position following an actuating movement of the input actuator, and (2) a second position wherein the portion of said actuating member is moved into a bypass position in which the portion is out of the path of movement of the output actuator following the rebound or manual movement of the contact trip assembly out of its operative position while the trigger member is retained in its operative position following an actuating movement of the input actuator;

moving a mode selecting member together with said actuating member relative to said trigger member between the first and second positions of said actuating member; and relatively moving the mode selecting member with respect to said actuating member so that said mode selecting member (a) retains said actuating member in the first position thereof in response to an initial movement of said trigger member to the operative position thereof, and (b) retains said actuating member in the second position thereof in response to an initial movement of said contact trip assembly into the operative position thereof and a subsequent movement of said trigger member into the operative position thereof.

2. A method according to claim 1, further comprising connecting said actuating member and said mode selecting member together and to said trigger member with a pivoting structure defining a pivotal axis for said actuating member, said actuating member being movable with respect to said trigger member between spaced positions toward and away from said output actuator corresponding to said first and second positions of said actuating member.

3. A method according to claim 2, further comprising resiliently biasing said pivoting structure and said pivotal axis toward and into the position thereof toward said output actuator with a spring.

4. A method according to claim 3, further comprising moving said mode selecting member during the initial movement of the trigger member into the operative position thereof into a position retaining said pivoting structure from moving against the bias of said spring out of the position thereof toward said output actuator so long as said trigger member is retained in the operative position thereof.

5. A method according to claim 2, further comprising during the initial movement of said contact trip assembly into the operative position thereof and the subsequent movement of said trigger member into the operative position thereof, moving said actuating member into the second position thereof;

moving said pivoting structure into the position thereof away from said output actuator; and moving said mode selecting member into a position retaining said pivoting structure in the position thereof away from said output actuator so long as said trigger member is retained in the operative position thereof.

6. A method according to claim 2, further comprising biasing said pivoting structure to move said actuating member toward and into the first position thereof so long as said contact trip assembly is in the inoperative position thereof; and moving said pivoting structure against said biasing to move the actuating member out of said first position toward the second position thereof in response to the initial movement of said contact trip assembly into the operative position thereof.

7. A method according to claim 2, further comprising retaining a portion of said mode selecting member in a first position with a frame of the fastener driving device after said trigger member has been initially moved into the operative position thereof; and retaining said actuating member in the first position thereof so long as said trigger member is retained in the operative position thereof, even after said contact trip assembly is moved into the operative position thereof.

8. A method according to claim 7, further comprising retaining said portion of said mode selecting member in a second position with the frame of the fastener driving device after said trigger member has been subsequently moved into the operative position thereof following an initial movement of said contact trip assembly into the operative position thereof, and retaining said actuating member in the second position thereof so long as the trigger member is retained in the operative position thereof.

* * * * *